US005834717A

United States Patent [19]

Neumeyer et al.

[11] Patent Number: 5,834,717

[45] Date of Patent: Nov. 10, 1998

[54] ON-LOAD TAP CHANGER OF A STEP SWITCH

[75] Inventors: Josef Neumeyer, Waldetzenberg; Leonhard Pillmeier, Regensburg, both of Germany

[73] Assignee: Maschinenfabrik Reinhausen GmbH, Regensburg, Germany

[21] Appl. No.: 817,186

[22] PCT Filed: Jan. 31, 1996

[86] PCT No.: PCT/EP96/00400

§ 371 Date: Mar. 25, 1997

§ 102(e) Date: Mar. 25, 1997

[87] PCT Pub. No.: WO96/30922

PCT Pub. Date: Oct. 3, 1996

[30] Foreign Application Priority Data

Mar. 24, 1995 [DE] Germany ..... 195 10 809.4

[51] Int. Cl.[6] ..... H01H 3/00; H01H 19/58; H01H 5/500

[52] U.S. Cl. ..... 200/17 R; 200/11 TC; 200/18; 200/400

[58] Field of Search ..... 200/4, 17 R, 11 TC, 200/18, 400; 323/341, 343

[56] References Cited

U.S. PATENT DOCUMENTS

| | | | |
|---|---|---|---|
| 3,798,395 | 3/1974 | Norman et al. | 200/17 R |
| 4,595,806 | 6/1986 | Itoh | 200/11 TC |

FOREIGN PATENT DOCUMENTS

| | | |
|---|---|---|
| 1613646 | 5/1971 | Germany . |
| 1956369 | 5/1971 | Germany . |
| 23 48 091 D2 | 9/1973 | Germany . |
| 28 06 282 C2 | 2/1978 | Germany . |
| 2747489 | 4/1979 | Germany . |
| 42 31 353 A1 | 4/1993 | Germany . |
| 195 10 809 C1 | 3/1995 | Germany . |
| 2008325 | 5/1979 | United Kingdom . |
| 2014794 | 8/1979 | United Kingdom . |
| WO 89/08924 | 9/1989 | WIPO . |

*Primary Examiner*—Michael L. Gellner
*Assistant Examiner*—Michael I. Hayes
*Attorney, Agent, or Firm*—Herbert Dubno; Andrew Wilford

[57] ABSTRACT

An on-load tap changer of a step switch has a force-storage unit which has a charging slide continuously movable by a bidirectionally rotatable drive shaft and an output part that when tripped suddenly follows the movement of the charging slide and rotates a switching shaft. Respective switches for each phase are each actuatable by respective actuating elements that coact with edges of respective concentric cams rotatable by the switching shaft. An axially movable switching unit is mounted on the switching shaft and the switching unit carries cam disks for actuating the switches, each cam disk being subdivided into an upper and a lower subdisk with different shapes. The switching unit is movable in a direction dependent on the rotation direction of the drive shaft into an upper or a lower position. In the upper position of the switching unit all of the lower cam subdisks and in the lower position of the switching unit all of the upper cam subdisks engage the actuating elements to actuate the respective switches.

8 Claims, 7 Drawing Sheets

ON-LOAD TAP CHANGER OF A STEP SWITCH

CROSS REFERENCE TO RELATED APPLICATIONS

This application is the U.S. national phase of PCT application PCT/EP96/00400 filed 31 Jan., 1996 with a claim to the priority of German application 195 10 809.4 filed 24 Mar., 1995.

FIELD OF THE INVENTION

The present invention relates to an on-load tap changer of a step switch.

BACKGROUND OF THE INVENTION

An on-load tap changer of a step switch has a force-storage unit which has a charging slide continuously movable by a bidirectionally rotatable drive shaft and an output part that when tripped suddenly follows the movement of the charging slide. A switching shaft is rotatable by the tripped output part and a switching system is provided for each phase that is actuatable by actuating elements that coact with edges of concentric cams rotated by the switching shaft.

Such tap changers are known from German patent publication 4,231,353. Per phase therein two vacuum switching tubes, subsequently referred to as VAC's, are provided; the actuation of these VAC's and of mechanical switching contacts takes place by means of a bidirectionally rotatable switching shaft that after tripping a force-storage unit is rotated rapidly. In this system for actuating the VAC's the switching shaft carries a cam disk which has on its edge for each VAC a cam formation on which a roller rides that works on the actuating lever of the respective VAC. The reversing of the mechanical contacts is also effected by a switching segment also rotated by the drive shaft and switching between fixed contacts arranged on the periphery of the on-load tap changer. With this tap changer the cam disks for the actuation of the two VAC's as well as the switching segment for actuating mechanical contacts are moved from one end position into the other and then again back independent of the actual movement direction of the step selector; this means that the contacts which have to be closed first on movement out, that is during rotation of the switching shaft in one direction, must on return movement, that is rotation of the switching shaft in the other direction, be first opened and vice versa.

Such a known tap changer is thus not suitable for making an asymmetrical switching circuit where independent of the switching direction the same contacts are always electrically switched or mechanically moved first. Such an asymmetrical switching circuit is for example described in the unpublished German patent document 4,407,945 as well as in a different form with double-pole switching specially for on-load tap changers in the also not published German patent document 4,441,082.

FIG. 4 shows the last-mentioned asymmetrical switching circuit with double-pole reversing wherein independent of the switching direction the same actuating sequence, that is succession, of moving or to be actuated switch means is described.

In WO 89/08924 there is described specially for thyristor circuits a particular spring snap drive which independent of its drive direction always is loaded in one direction, that is has only one output direction. This is one possibility of making in principle an asymmetrical switching circuit; the described spring-loaded force-storage unit is nonetheless of complex construction, requires a lot of space for a number of essential latching and coupling elements, and is also not suitable for the combined actuation of VAC's as electrical switching elements on the one side and mechanical contacts on the other side in a predetermined actuating sequence.

OBJECTS OF THE INVENTION

It is an object of the invention to provide an on-load tap changer of the above-described type that permits in a simple manner with a bidirectionally drivable switching shaft the formation of an asymmetrical switching circuit such that independent on the rotation direction the same actuating sequence of VAC's and of mechanical switching elements is achieved.

SUMMARY OF THE INVENTION

An on-load tap changer of a step switch according to the invention has a force-storage unit which has a charging slide continuously movable by a bidirectionally rotatable drive shaft and an output part that when tripped suddenly follows the movement of the charging slide and rotates a switching shaft. Respective switches for each phase are each actuatable by respective actuating elements that coact with edges of respective concentric cams rotatable by the switching shaft. An axially movable switching unit is mounted on the switching shaft and the switching unit carries cam disks for actuating the switching means, each cam disk being subdivided into an upper and a lower subdisk with different shapes. The switching unit is movable in a direction dependent on the rotation direction of the drive shaft into an upper or a lower position. In the upper position of the switching unit all of the lower cam subdisks and in the lower position of the switching unit all of the upper cam subdisks engage the actuating elements to actuate the respective switches.

The main advantage of the invention is that a conventional force-storage unit that has a charging slide and an output part as described for example in German patent 2,806,282 can be used. In this case the charging slide produces during the continuous charging operation according to the invention an additional movement directed perpendicular to the charging direction and axial of the switching shaft in a coupling assembly described below. According to the invention for each switch element to be actuated, both VAC's as well as mechanical contacts, and for each actuation direction of the driving shaft there are respective different cam subdisks stacked on an axially shiftable switching unit mounted on the switching shaft; the above-described axial movement of the coupling assembly can serve to axially shift the cam subdisks responsible for the actual movements of the drive shaft and thus bringable into or out of contact with the respective switching elements for actuating the VAC's as well as the mechanical contacts depending on the rotation direction.

BRIEF DESCRIPTION OF THE DRAWING

The invention is more closely described in the following by way of example with reference to the drawing.

SPECIFIC DESCRIPTION

Figure 1:
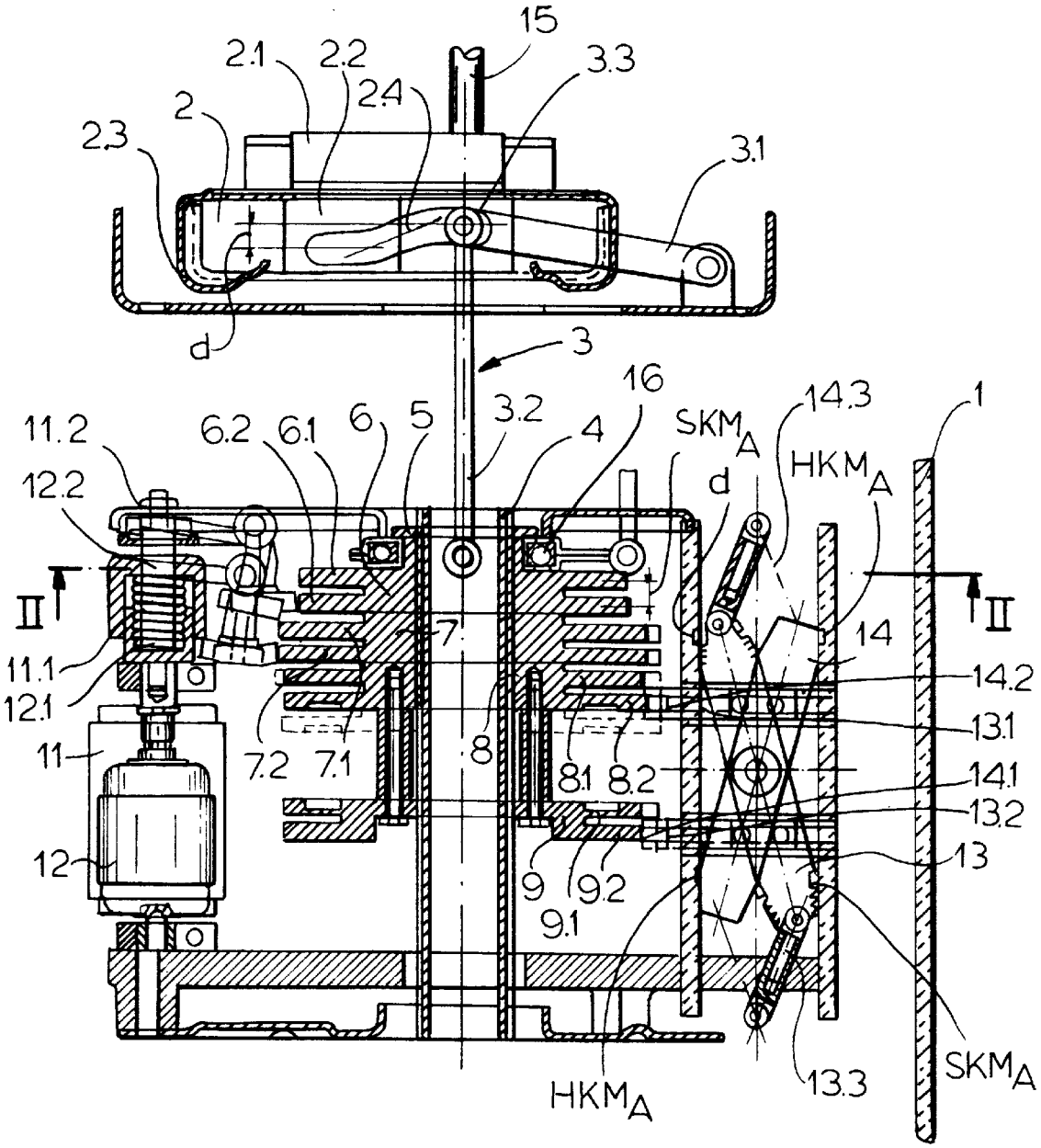
FIG. 1 shows an on-load tap changer according to the invention in a lateral sectional view.

The on-load tap changer according to the invention is comprised of a tap-changer housing, here an insulating cylinder 1, in which is arranged a central switching shaft 4. The switching shaft 4 is as is known actuated by a force-storage unit 2.

The force-storage unit 2 has a charging slide 2.2 that is continuously moved by a rotating drive cam 2.1 of a drive shaft 15 that on reaching its end position snaps out an output part 2.3 that again in a known and here not more closely described manner drives the switching shaft 4.

In addition according to the invention there is provided laterally on the lifting slide 2.2 a cam formation 2.4, here on both sides, in each of which a roller 3.3 of a coupling assembly 3 engages. The coupling assembly 3 is formed again of two links 3.1 which are pivoted laterally at the level of the force-storage unit 2 as well as of two connecting rods 3.2 linked to them that extend downward vertically in the tap-changer housing parallel to the switching shaft 4 and which are connected at their free ends with a switching unit 5 shiftable axially on the switching shaft 4.

It is of course also possible to provide a formation 2.4 laterally on only one side of the lifting slide 2.2 and correspondingly to have only one coupling assembly, but the described paired arrangement has advantages with respect to stability.

The described formation is shaped such—that according to the direction of motion of the lift slide 2.2 of the force-storage unit 2—by means of the coupling assembly 3 on raising of the force-storage unit 2, that is before the actual tap changing, the switching unit 5 is moved axially on the switching shaft 4 through a certain step a upward or downward.

The switching unit 5 is shiftable axially on the switching shaft 4 and is rotatable jointly therewith by the charged force-storage unit 2 which is for example possible due to the multiply toothed formation of the switching shaft 4 that as a result has an integral grip on the switching unit 5 without interfering with its axial movability. To ensure this operation there is between the lower part of the coupling assembly 3 and the switching unit 5 for example a journal or roller bearing 16.

Two vertically stacked cam disks 6 and 7 are arranged on the switching unit 5 with edge cam formations for actuating two respective VAC's 11 and 12 and are formed of an upper cam subdisks 6.1 and 7.1 and immediately thereunder lower cam subdisks 6.2 and 7.2. Furthermore two cam disks 8 and 9 are mounted on the switching unit 5 for actuating two mechanically movable contacts 13 and 14 which are described below.

Laterally arranged against the respective cam disks 6 and 7 are respective actuating rollers 11.1 and 12.1 that according to the position of the switching unit 5 act on the two upper cam subdisks 6.1 and 7.1 or the two lower cam subdisks 6.2 and 7.2. These actuating rollers 11.1 and 12.1 are effective via L-shaped levers 11.2 and 12.2 on the respective VAC's 11 and 12 and actuate them. In the stationary condition of the on-load tap changer there is a space between each of the actuating rollers 11.1 and 12.1 and the respective cam subdisks 6.1, 7.1 and 6.2, 7.2 since the VAC's 11 and 12 in the stationary condition without external influence are closed; these are only during the tap changing physically actuated by the respective cam subdisks via the respective rollers and the respective actuating levers and briefly opened. This described space in the stationary condition makes it possible to move the switching unit 5 and thus the cam disks 6 and 7 without having a collision between them and the actuating rollers 11.1 and 12.1.

In a similar manner there are provided on the switching unit 5 the two further cam disks 8 and 9 for actuating the two movable mechanical contacts 13 and 14. The cam disks 8 and 9 are also subdivided into vertically separate cam subdisks 8.1, 8.2 and 9.1, 9.2. Dependent on the rotation direction of the switching shaft either the two upper subdisks 8.1 and 9.1 or the two lower cam subdisks 8.2 and 9.2 laterally engage first rollers 13.1 and 14.1 or second rollers 13.2 and 14.2. FIG. 1 shows engagement with the two lower cam subdisks 8.2 and 9.2.

The rollers 13.1, 14.1 and 13.2 and 14.2 are connected with respective spring-loaded L-shaped levers 13.3 and 14.3 so that these can be brought through a dead point into two switching positions. The first mechanical contact 13 is effective as switching contact SKM and connects together according to its position either the two fixed contacts $SKM_A$ or the two fixed contacts $SKM_B$. The second movable contact 14 is effective as a mechanical auxiliary contact HKM and connects together according to its position either the two fixed auxiliary contacts $HKM_A$ or the two fixed auxiliary contacts $HKM_B$. The two movable mechanical contacts 13 and 14 are arranged in the same horizontal plane.

The actuation of the rollers 13.1, 14.1 and 13.2 and 14.3 and thus of the two L-shaped levers 13.3 and 14.2 by the respective cam subdisks 8.1, 9.1 and 8.2, 9.2 of the cam disks 8 and 9 is via a mechanical connection, that is in the stationary position the cam disks 8 and 9 and the rollers 13.1, 14.2 and 13.2 and 14.2 are not in contact so that—as further described above for the actuation of the VAC's—before the start of the tap changing an axial movement of the switching unit 5 is possible without problems, in particular without colliding with any actuating elements, here the rollers.

Between the actuation of the VAC's 11 and 12 and the mechanical contacts 13 and 14 there is still a substantial difference:

The VAC's 11 and 12 are constructed so that they are always closed in the stationary condition, that is they have a stable position they assume when not acted on by an outside force, as a result of the vacuum inside them and an additional spring. As a result a single cam disk is sufficient for actuation, that is the delayed switching into the other position. As soon as the cam stops being effective, the VAC returns automatically into the stable closed position.

The opposite is the case for the described mechanical contacts 13 and 14. Here each movable contact 13 and 14 that is pivotal about a point by the respective spring-loaded L-shaped lever 13.3 or 14.3 can be moved past a dead point and assume two stable positions. Each movable mechanical contact 13 and 14 is associated with an upper first roller 13.1 or 14.1 which effects an alternating switching between the two stable switch positions.

In order to simplify the construction of the on-load tap changer it is also possible to combine the two separately shown cam disks 8 and 9 of the example into a single cam disk with only one upper and one lower cam subdisk such that in any switch position the actuation of SKM as well as of HKM is effected only by a single cam subdisk.

Figure 2:
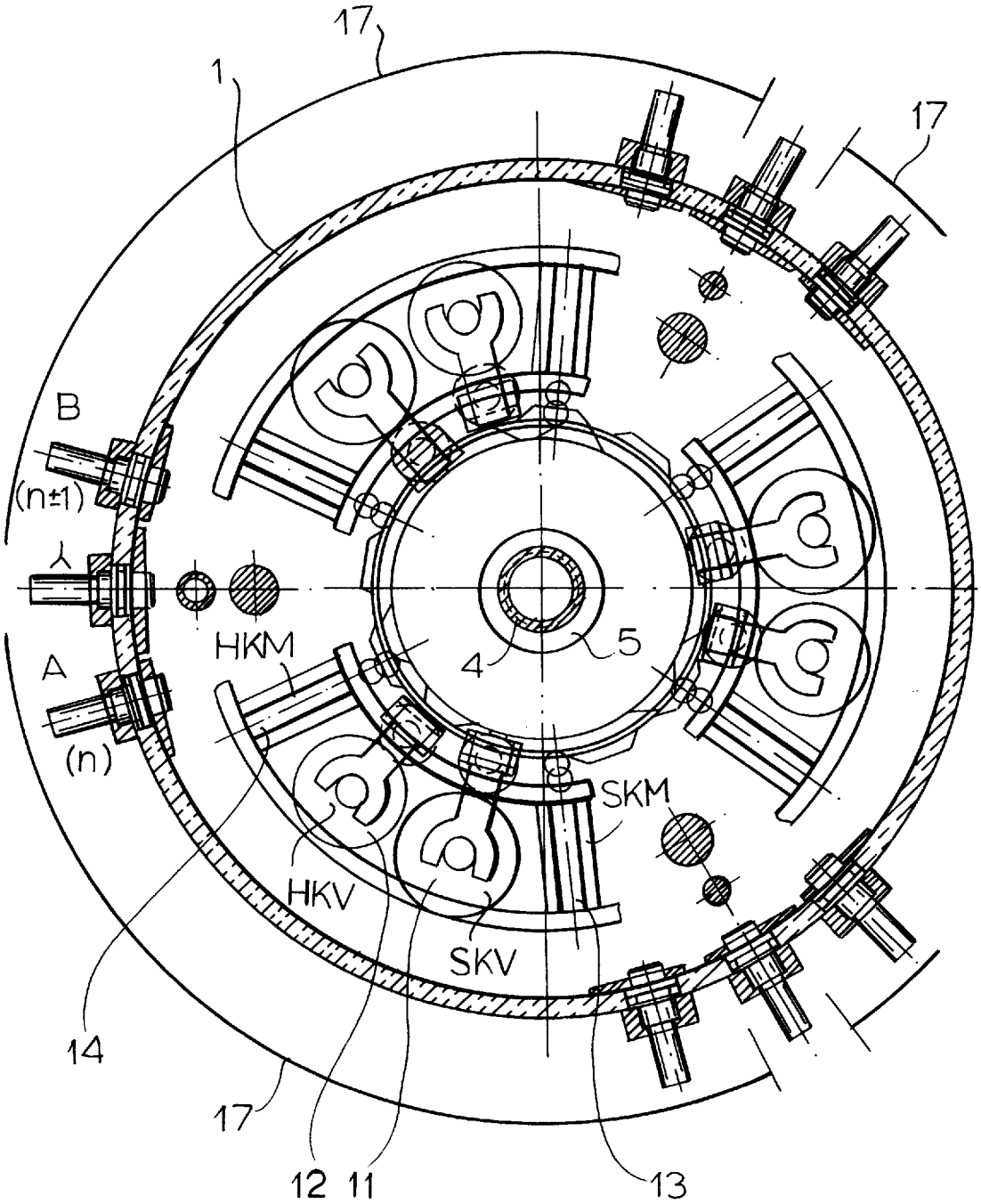
FIG. 2 also shows this on-load tap changer in cross section on the plane A—A.
Figure 3:
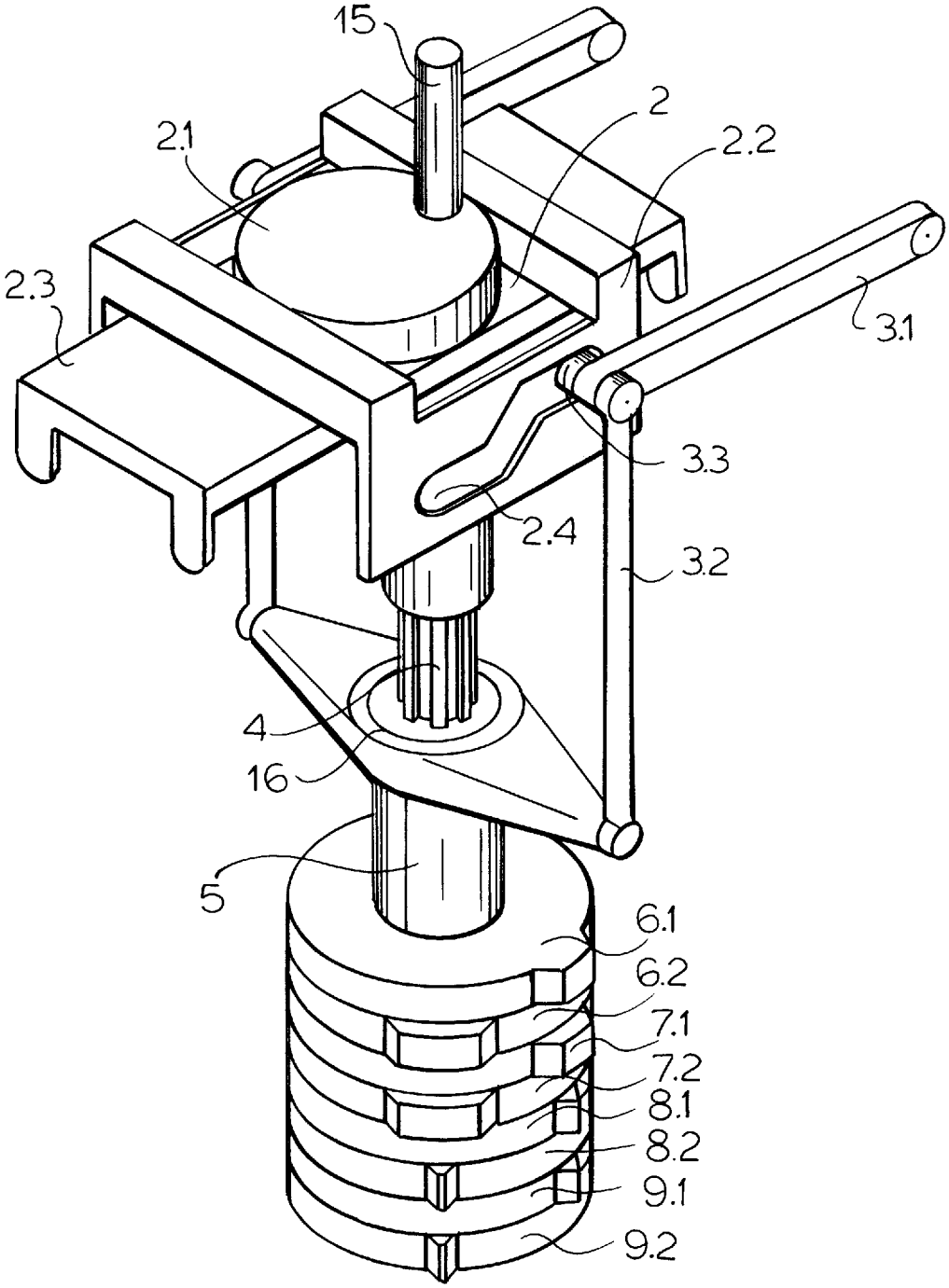
FIG. 3 shows a force-storage unit with a coupling assembly according to the invention all alone in a perspective view.

The above descriptions relate only to a one-phase on-load tap changer according to the invention. With a three-phase on-load tap changer the described mechanical and electrical actuating and switching element of all three phases are particularly advantageously arranged in a single horizontal plane. FIG. 2 shows such an arrangement schematically from above.

Figure 4:
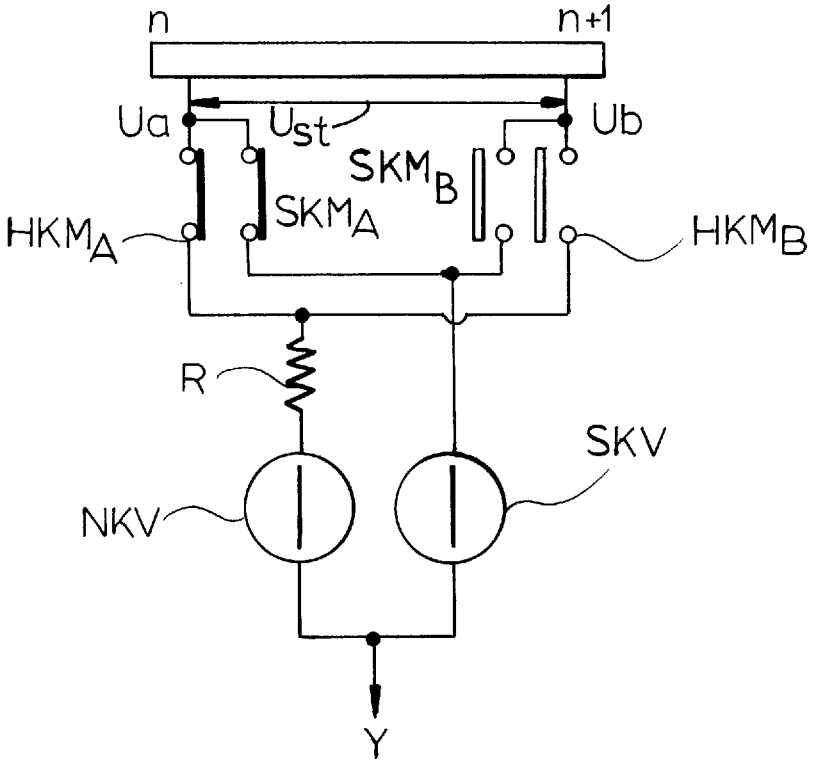
FIG.4 PRIOR ART
FIG. 4 shows a known asymmetrical switching circuit made with the invention.
Figure 5:
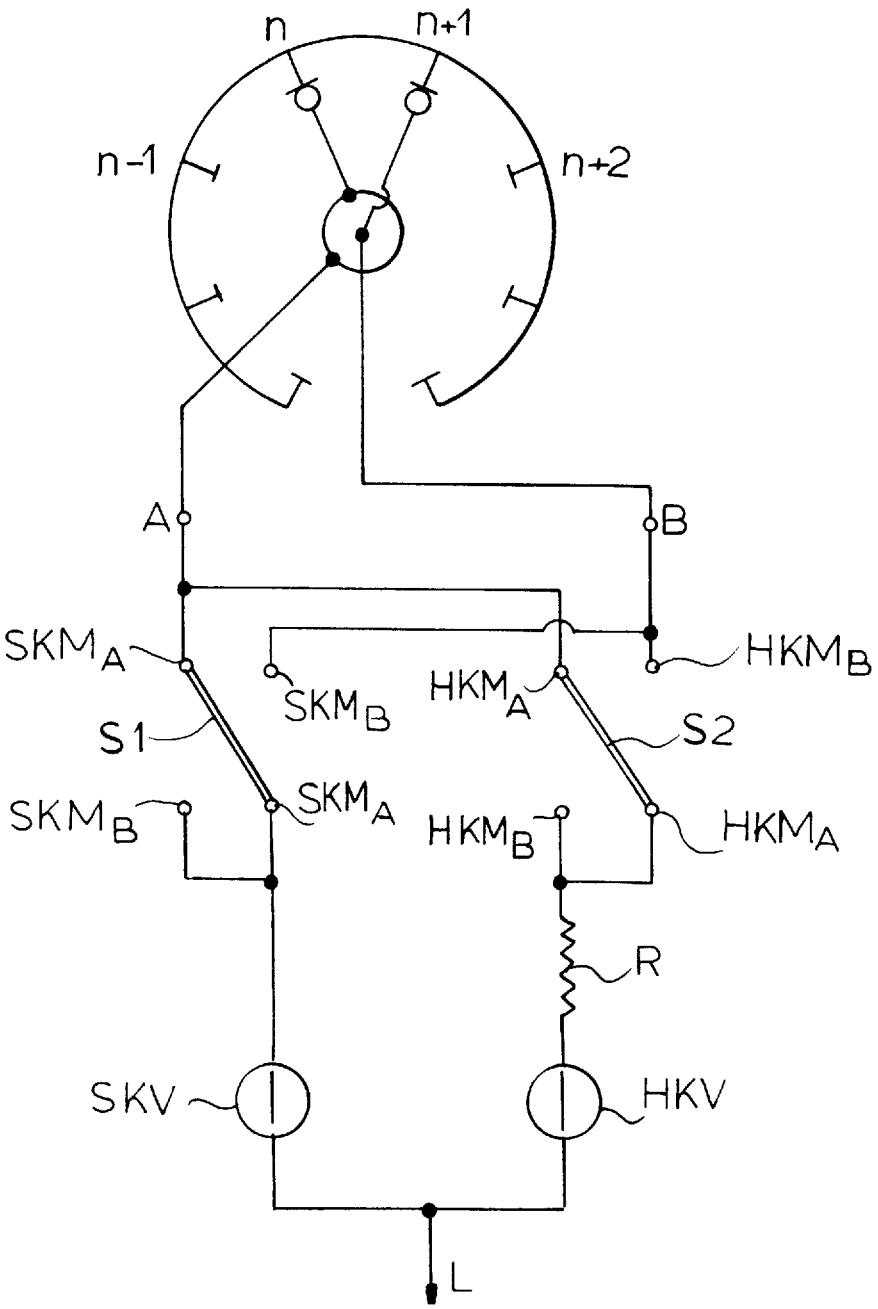
FIG. 5 shows this switching circuit with switching contacts that as shown in FIG. 1 are pivotal about a point and formed as a reverser.
Figure 6:
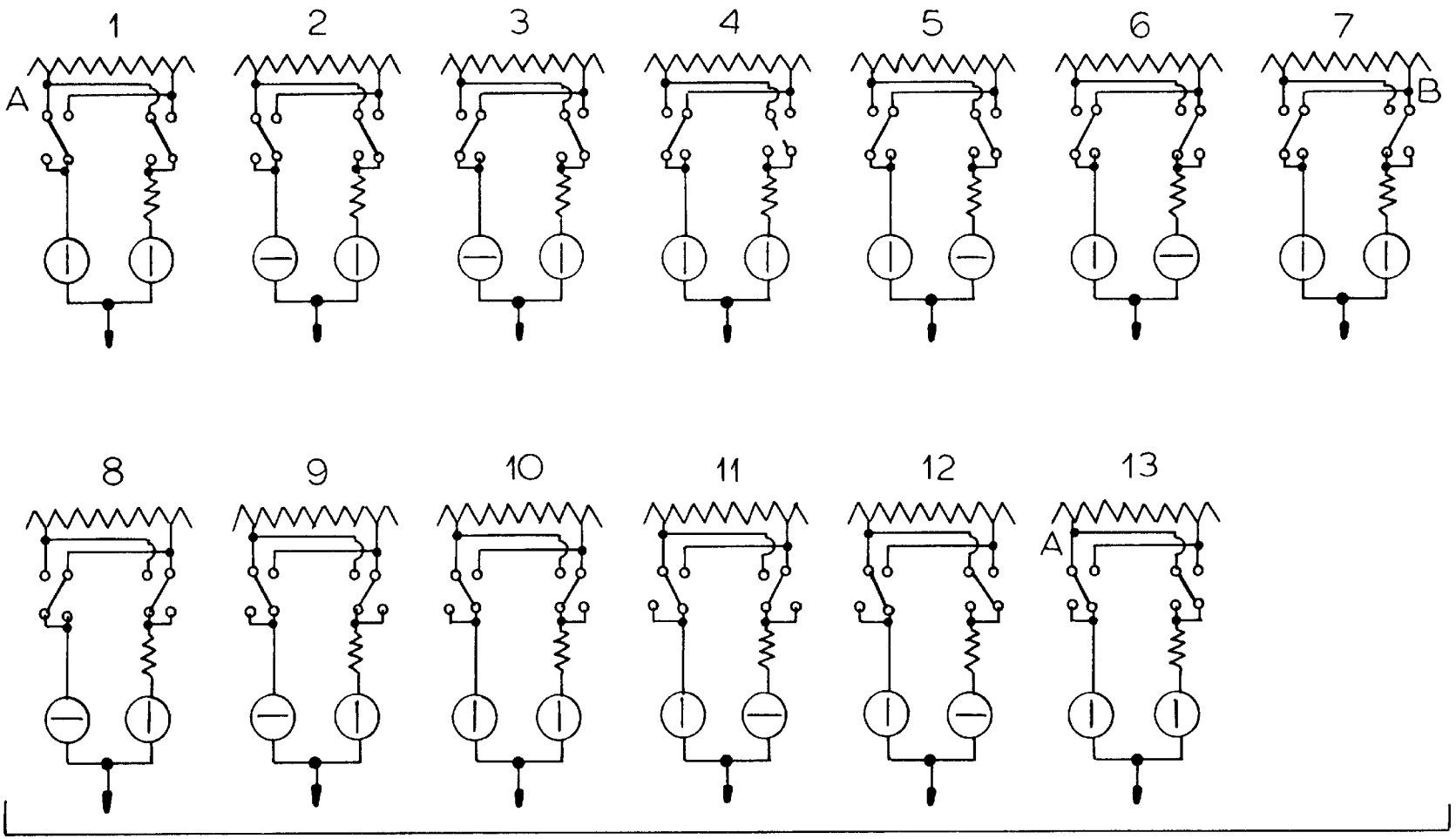
FIG. 6 shows the switching sequence of the switching circuit of FIG. 5.
Figure 7:
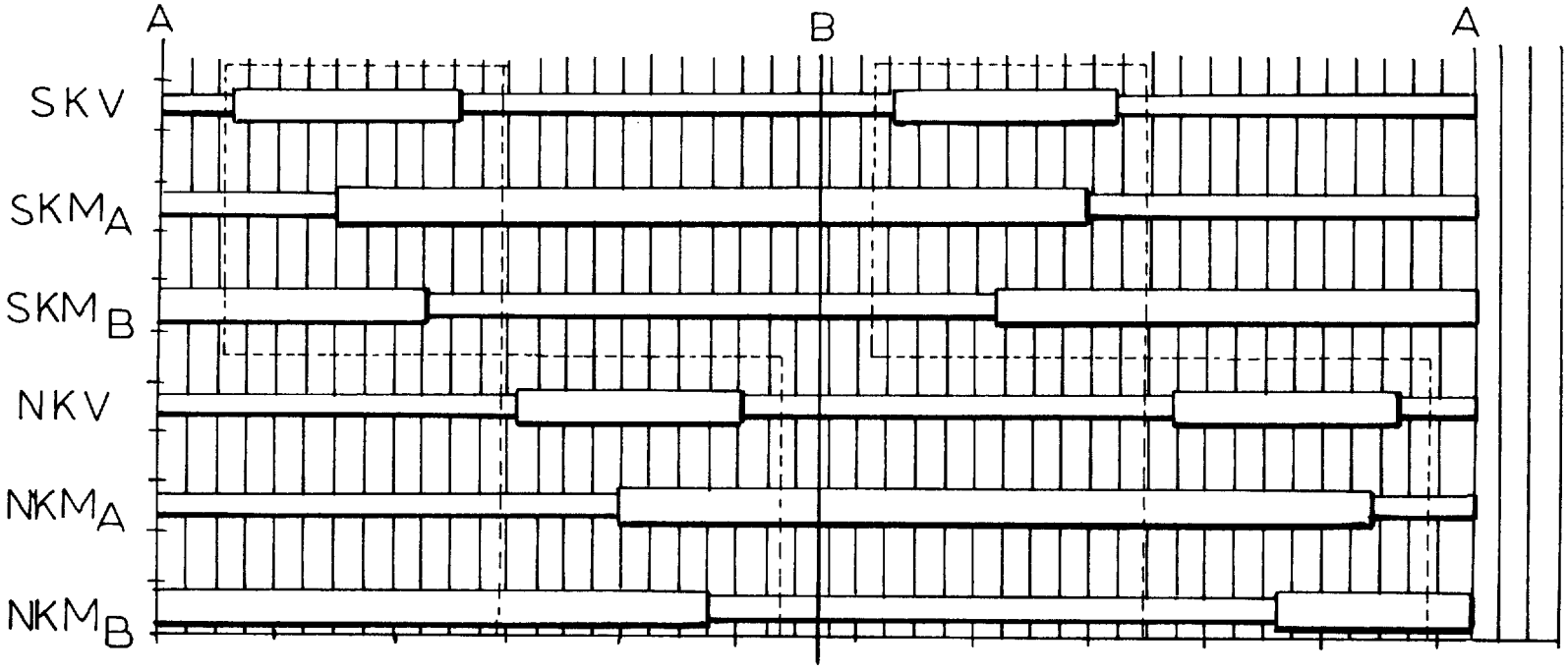
FIG. 7 shows the corresponding switching diagram.

One can see that inside the insulating cylinder 1 the switching shaft 4 is arranged with the rotatable switching unit 5 that is axially movable relative to it but jointly rotatable with it, along with the stacked cam disks 6, 7, 8. and 9 with the respective cam subdisks. One can further see that centrally about these cam disks there are arranged the two VAC's with one effective as the electrical switching contact SKV and the other as electrical auxiliary contact HKV according to the switching circuit of FIG. 4 as well as the mechanical contacts for two-pole switching, with the one as a mechanical switch SKM and the other as a mechanical auxiliary contact HKM. The regions in which each of the switching and actuating means of a phase are arranged are outlined by the regions indicated by arrows at 17 in FIG. 2.

Of course it is possible to have an additional arrangement of known continuous-duty contacts for continuous current feed, that is to relieve the switching contacts in stationary use. Such switching circuits having continuous-duty contacts are known. Since the continuous-duty contacts are, independent of the switching direction on tap changing, the first to open and the last to close, their actuation can be effected in the known manner by a cam fixed on the switching shaft 4. Switching-direction dependent axial movement is not necessary. In this embodiment such continuous-duty contacts are left out because they are known.

The invention allows overall a simple system of asymmetrical switching circuits, that is a mechanically simple conversion of the same actuating steps of electrical and mechanical switching steps in an on-load tap changer independent of its switching direction which alternate because of the bidirectionally chargeable force-storage unit. The necessary movement for the switching-direction dependent movement according to the invention is produced in a simple manner during the continuous movement of the charging slide of a known force-storage unit before the start of the actual switching operation. Thus only the described additional cam formation is necessary on the side of the charging slide; except for this easily made change the known force-storage unit can be used without changes which has further advantages.

It is understood that the number and shape of the cam disks and the actuating and switching elements and also of the electrical and the mechanical switching elements are determined according to the switching circuit needed and the invention is not limited to the described embodiment with two VAC's per phase and two double-pole mechanical switch contacts per phase.

We claim:

1. In an on-load tap changer of a step switch comprising a force-storage unit which has a charging slide continuously movable by a bidirectionally rotatable drive shaft and an output part that when tripped suddenly follows the movement of the charging slide, a switching shaft rotatable by the tripped output part, and respective switching means for each phase that are each actuatable by respective actuating elements that again coact with edges of respective concentric cams rotatable by the switching shaft, the improvement wherein an axially movable switching unit is mounted on the switching shaft, the switching unit carries cam disks for actuating the switching means, each cam disk is subdivided into an upper and a lower subdisk with different shapes, and the switching unit is movable in a direction dependent on the rotation direction of the drive shaft into an upper or a lower position wherein in the upper position of the switching unit all of the lower cam subdisks and in the lower position of the switching unit all of the upper cam subdisks engage the actuating elements to actuate the respective switching means.

2. The on-load tap changer according to claim 1 wherein the switching unit is physically connected by means of a coupling assembly with a cam formation on the slide of the force-storage unit such that on movement of the slide the switching unit is moved up or down into an upper or a lower position according to the direction.

3. The on-load tap changer according to claim 1 wherein the switching means has for each phase at least two vacuum-switching tubes and at least two mechanical contacts.

4. The on-load tap changer according to claim 3 wherein each actuating element for actuating the vacuum switch is formed of a fixing roller connected with the respective subdisk and an L-shaped lever connected thereto.

5. The on-load tap changer according to claim 3 wherein each actuating element for actuating the mechanical contact comprises a first and a second roller connected physically with the respective subdisk as well as a spring-loaded L-shaped lever such that depending on whether the first roller or the second roller is pushed the respective mechanical contact is moved between two stable positions.

6. The on-load tap changer according to claim 5 wherein all the first rollers on the one side and all the second rollers on the other side are connected with the same subdisks.

7. The on-load tap changer according to claim 3 wherein the mechanical contacts are formed as double-pole switching contacts.

8. The on-load tap changer according to claim 3 wherein the further cam disks for actuating the mechanical contacts are joined together to a single cam disk which is subdivided into upper and lower subdisks with different shapes.

* * * * *